US008613453B2

(12) United States Patent
Chen

(10) Patent No.: US 8,613,453 B2
(45) Date of Patent: Dec. 24, 2013

(54) WHEEL SKATE DEVICE WITH PLATFORM LOCKING MECHANISM

(76) Inventor: Shane Chen, Camas, WA (US)

( * ) Notice: Subject to any disclaimer, the term of this patent is extended or adjusted under 35 U.S.C. 154(b) by 0 days.

(21) Appl. No.: 13/338,043

(22) Filed: Dec. 27, 2011

(65) Prior Publication Data

US 2013/0161916 A1 Jun. 27, 2013

(51) Int. Cl.
*A63C 17/08* (2006.01)

(52) U.S. Cl.
USPC ..... 280/11.24; 280/87.042; 280/87.05

(58) Field of Classification Search
USPC ..... 280/11.24, 11.27, 11.209, 63, 87.05, 280/87.042, 253
See application file for complete search history.

(56) References Cited

U.S. PATENT DOCUMENTS 4,709,937 A * 12/1987 Lin et al. ..... 280/11.209
4,991,861 A * 2/1991 Carn et al. ..... 280/87.042
D347,044 S * 5/1994 Slack et al. ..... D21/763
5,779,247 A * 7/1998 Anselmo ..... 280/11.24
6,382,640 B1 * 5/2002 Killian ..... 280/11.24
6,626,453 B1 * 9/2003 Theus et al. ..... 280/652
6,705,630 B1 * 3/2004 Karpman ..... 280/253
7,059,613 B2 * 6/2006 Farrelly et al. ..... 280/11.27
7,150,461 B2 * 12/2006 Schnuckle et al. ..... 280/87.05
D624,136 S * 9/2010 Chen ..... D21/760
7,980,568 B2 * 7/2011 Chen ..... 280/11.24
8,113,524 B2 * 2/2012 Karpman ..... 280/63

* cited by examiner

*Primary Examiner* — Hau Phan

(57) ABSTRACT

A wheel skate device having a foot platform, a frame, and a ring-shaped wheel. The user operates a pair of the wheel skate devices while standing with one foot on each foot platform. The foot platform is movable between an in-use position and a stowage position. In the in-use position. the foot platform interlocks with the frame and can be secured with a locking pin. A pair of the wheel skate devices in stowage position can be connected together as a single unit using a connecting piece, which may have an attached strap for carrying or hanging. A mechanism which limits the wheel to rolling in only one direction, and an elastic band linking two wheel skate devices together to prevent the user's feet from accidentally moving too far apart, are useful learning aids.

9 Claims, 8 Drawing Sheets

Detail A

WHEEL SKATE DEVICE WITH PLATFORM LOCKING MECHANISM

FIELD OF THE INVENTION

The present invention relates to human powered wheeled transportation devices that encircle the foot of the user during use.

BACKGROUND OF THE INVENTION

U.S. Pat. No. 6,705,630 describes a human powered wheeled transportation device that uses wheel skates each encircling the foot of the user during use. Each of the wheel skates has a respective wheel, an inner circular rim and an outer circular rim spaced from the inner circular rim by bearings. The inner circular rim supports a foot placement platform. A pivot link extends between the inner circular rims of two wheel skates to connect them together. Such has the effect of constraining the foot placement platform against moving relative to the frame so as to keep the inner circular rims and thereby the foot placement platforms stationary. The pivot link enables the user to keep just one foot in one of the foot placement platforms while resting the other foot on the frame if desired.

U.S. Pat. No. 7,059,613 also describes a human powered wheeled transportation device that that permits independent foot movement with two small wheels provided under a user's foot. However, no wheel encircles the user's foot.

U.S. Pat. No. 7,980,568, by the present inventor, describes a human powered wheeled transportation device that encircles the foot of the user during use and yet provided for independent foot movement.

These types of devices are commonly operated by moving one's feet in oscillating "wave" motion. Since this method can be difficult to learn, a need exists for learning aids such as a means for limiting the wheels to moving in only one direction (to help the user propel himself in that direction), and a means for maintaining the distance between the user's feet in an optimal range.

It would also be beneficial to have a means for making the two wheel skate devices more convenient to carry or stow together.

SUMMARY OF THE INVENTION

One aspect of the invention resides in a human powered wheeled transportation device, i.e., a wheel skate device that encircles the foot of the user during use and yet provides for independent foot movement. The device may include a frame with two spaced apart frame elements, rotary couplings in the space between the two frame elements, at least one wheel arranged on the rotary couplings to rotate relative to the frame, and a foot placement platform. The platform projects outwardly from the frame to accommodate placement of a user's foot thereon. The frame and the platform may rotate in unison with each other back and forth about the wheel axis relative to the at least one wheel. The rotary couplings may be bearings or wheels. The platform extends beneath an axial rotational center of the wheel.

The wheel skate device is preferably free of any constraint that would substantially prevent the platform (or the frame to which the platform is attached) from rocking back and forth relative to the at least one wheel, that is, beyond an extent otherwise permitted due to tolerance in manufacture and arrangement of the wheel, frame and platform. For instance, the pivot link of U.S. Pat. No. 6,705,630 is inflexible in a vertical direction under operation on pavement and substantially prevents rocking back and forth of its foot placement platform relative to its wheel.

In use, a user places both feet on respective foot placement platforms while two skates are on the ground such as a paved roadway. The user moves sideways by alternating the feet in a forward and backward motion separately, and twisting both feet inward and outward upon initiating the forward and backward motion.

The foot placement platform may be detachable from the frame to be moved between the operative position and the stowed position. Extruding shapes on the foot placement platform match with mirroring features on the frame, such that the foot placement platform and the frame can interlock when the foot placement platform is in an in-use position. A locking pin may be further provided to additionally secure the foot placement platform in place.

A connecting piece, having a shape mirroring that of the extruding features on the frame, can interlock with the frame when the foot platform is in stowage position. Two wheel skate devices can be coupled to the connecting piece in this manner for conveniently carrying or stowing the pair as a single unit.

A direction restricting mechanism may be used as a learning aid for the wheel skate device by blocking rotation of the wheel in one direction while allowing the wheel to spin freely in the other direction. This is helpful to a beginning user who has not yet mastered the "oscillating" method of propulsion.

Another useful learning aid is an elastic band linking two of the wheel skate devices together, for preventing the user's feet from moving farther apart than the user intends. A rod in the middle of the elastic band additionally prevents the user's feet from moving too close together. In this way a beginning user can become familiar with how to maintain the separation of his feet within an optimum range.

DETAILED DESCRIPTION

Figure 1:
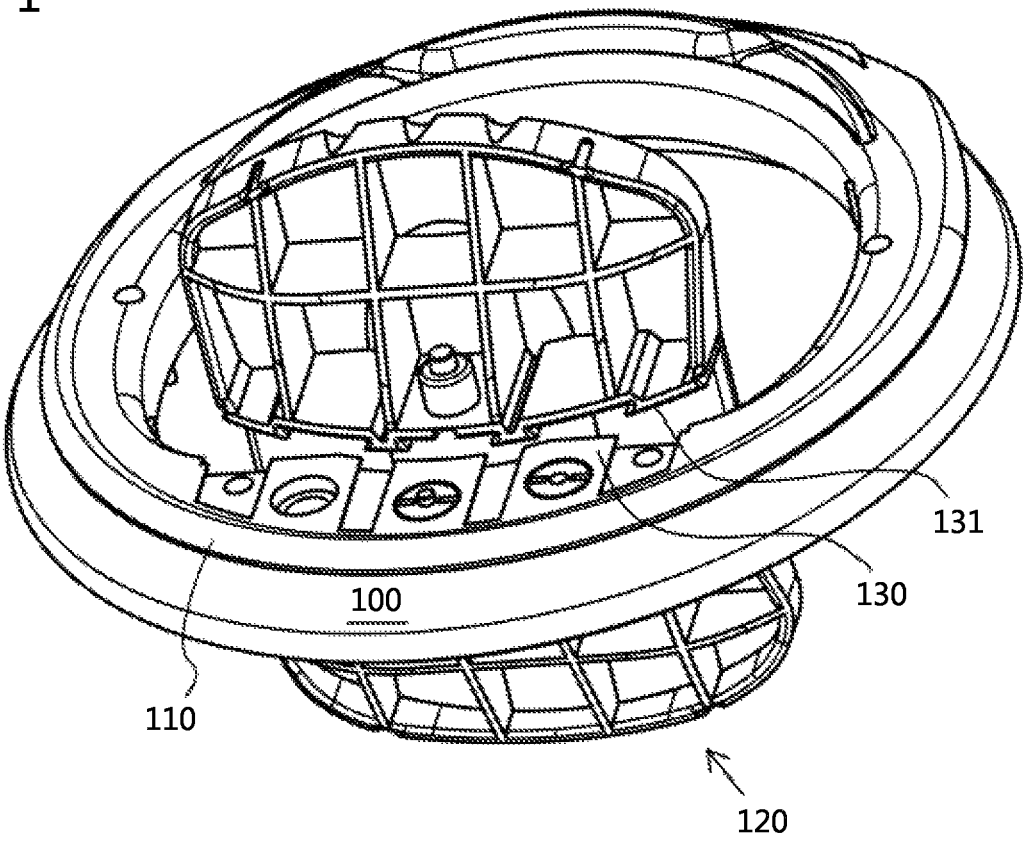
FIG. 1 shows a perspective view of a wheel skate device from below, with the foot platform shown detached.

Referring to FIG. 1, a perspective view of one embodiment of a wheel skate device in accordance with the present invention is shown. The wheel skate device comprises a ring-shaped wheel 100 supported by a frame 110 and a foot platform 120 detachably coupled to frame 110 for supporting the foot of a human user. For attaching and detaching foot platform 120 to frame 110, a plurality of extruding portions 130, 131 are respectively provided on frame 110 and on foot platform 120, on surfaces opposite each other, such that foot platform 120 may be coupled to frame 110 by matching extruding portions 130 with the corresponding negative spaces formed between extruding portions 131, and vice versa, and sliding foot platform 120 into place. This requires that extruding portions 130, 131 have cross-sections shaped such that, when interlocked, foot platform 120 and frame 110 may move relative to each other in only one direction. In this embodiment the extruding portions have a trapezoidal or "ducktail" shape.

Figure 2:
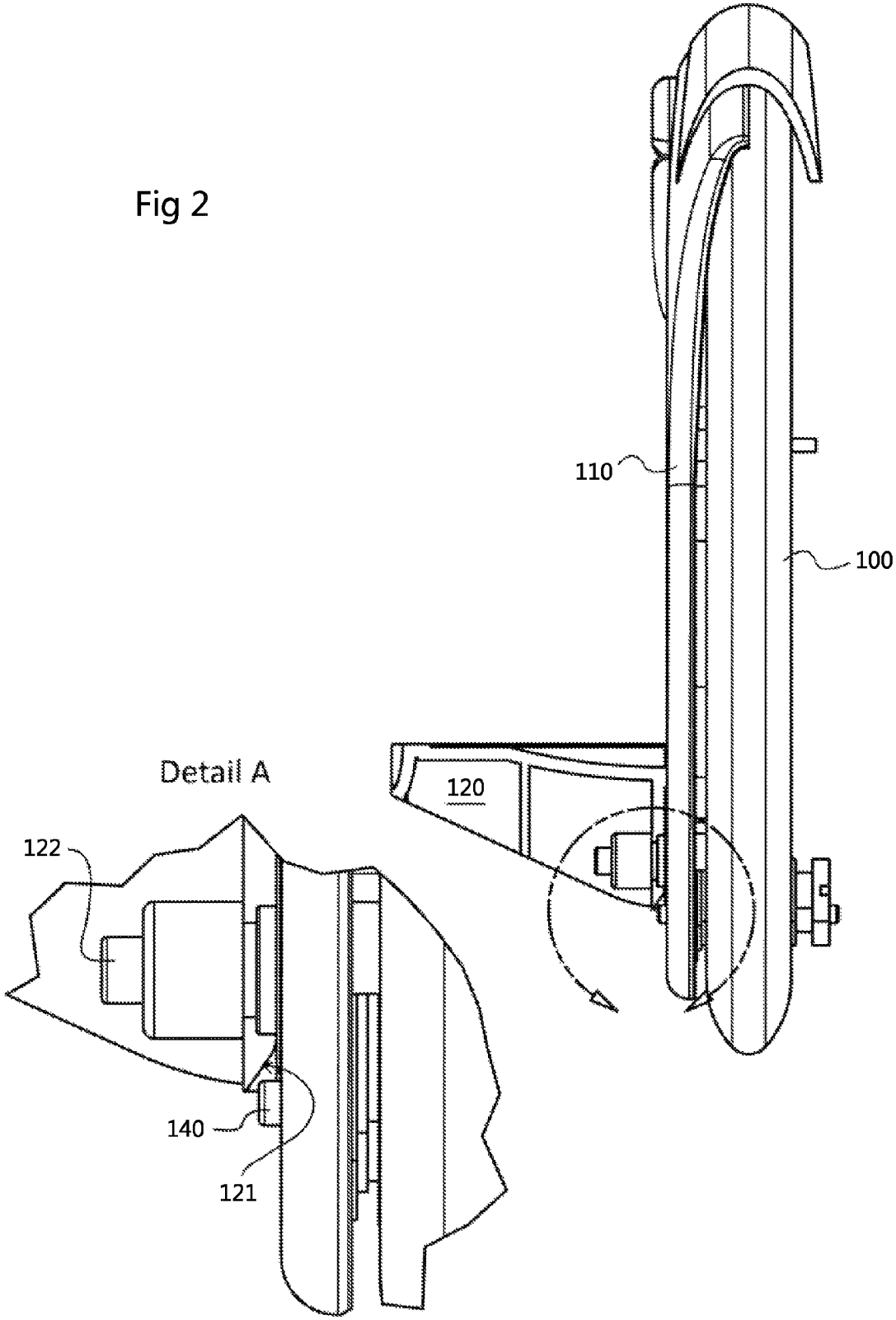
FIG. 2 shows a side elevational view of the wheel skate device of FIG. 1, where the majority of the right half of the frame is not shown. Detail A is a closer side elevational view of the foot platform locking and release features from the circled area in FIG. 2.

Referring to FIG. 2, a side elevational view of a wheel skate device in accordance with the present invention is shown. In addition to the features described above, the wheel skate device further comprises a locking pin 140 encased in and protruding from the side of frame 110. Locking pin 140 is capable of sliding along its axis between a flush position in which locking pin 140 does not substantially extend beyond the outer surface of frame 110, and an extruding position wherein locking pin 140 extends beyond the outer surface of frame 110. A cavity of size and shape comparable to that of the extended portion of locking pin 140 is provided in foot platform 120 and is capable of receiving locking pin 140 when foot platform 120 is fully coupled to frame 110. Locking pin 140 may be biased toward the extruding position. Extruding portions 130 and 131 and locking pin 140 may be on only one side of frame 110, or there may be a substantially identical arrangement on the other side of frame 110 as well.

Figure 3:
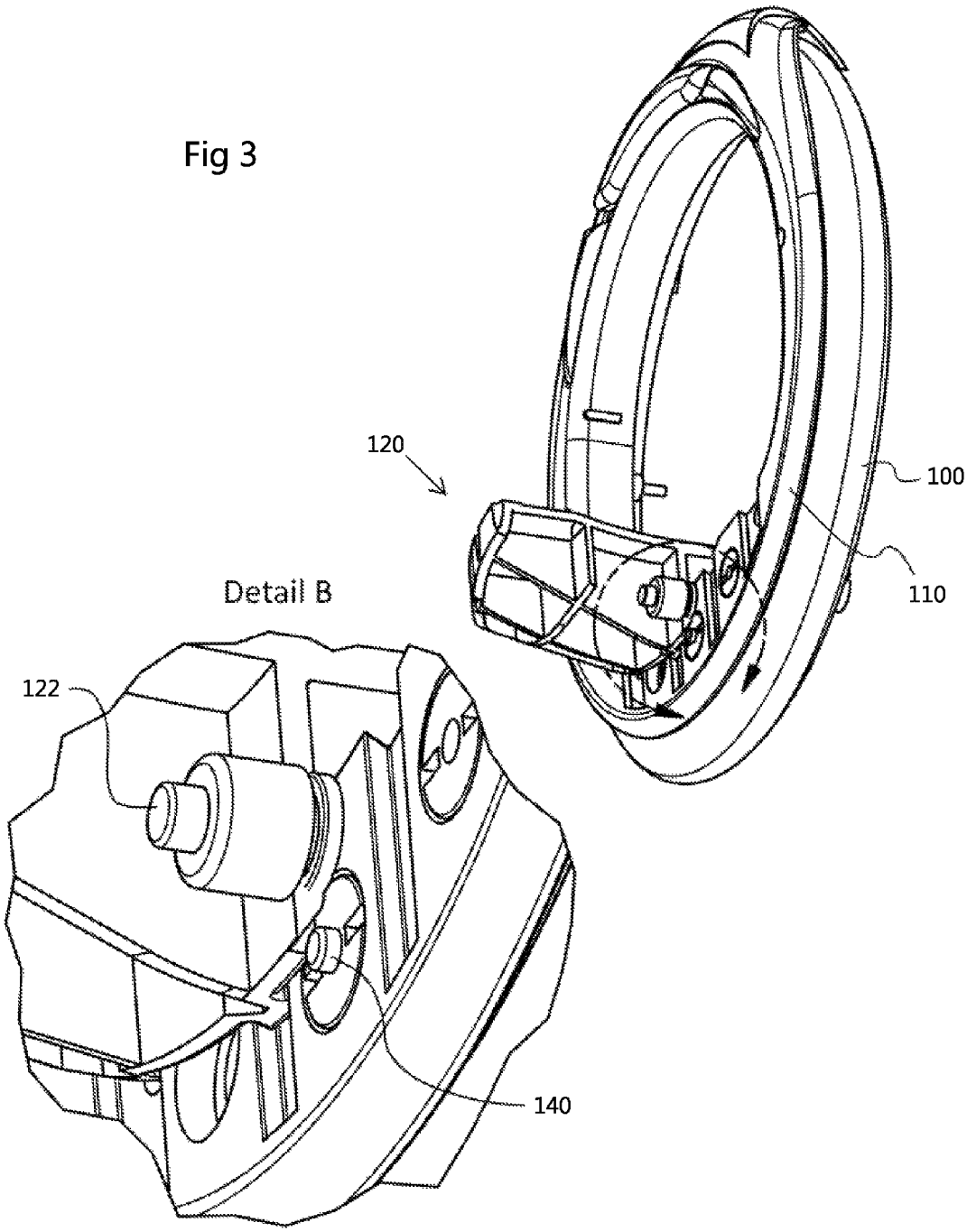
FIG. 3 shows another perspective view of the wheel skate device of FIG. 1. Detail B is a closer perspective view of the foot platform locking and release features from the circled area in FIG. 3.

Foot platform 120 may comprise a sloped surface 121 (shown in Detail A of FIG. 2) which presses locking pin 140 into the flush position as foot platform 120 is slid onto frame 110. After being depressed by sloped surface 121, locking pin 140 reaches the cavity in foot platform 120 and clicks back into extruding position, thus securing foot platform 120 in place. Foot platform 120 may further comprise release button 122 disposed on the axis of locking pin 140, as shown in FIG. 3. When depressed, release button 122 pushes locking pin 140 into flush position, and foot platform 120 is free to uncouple from wheeled body 110.

Figure 4:
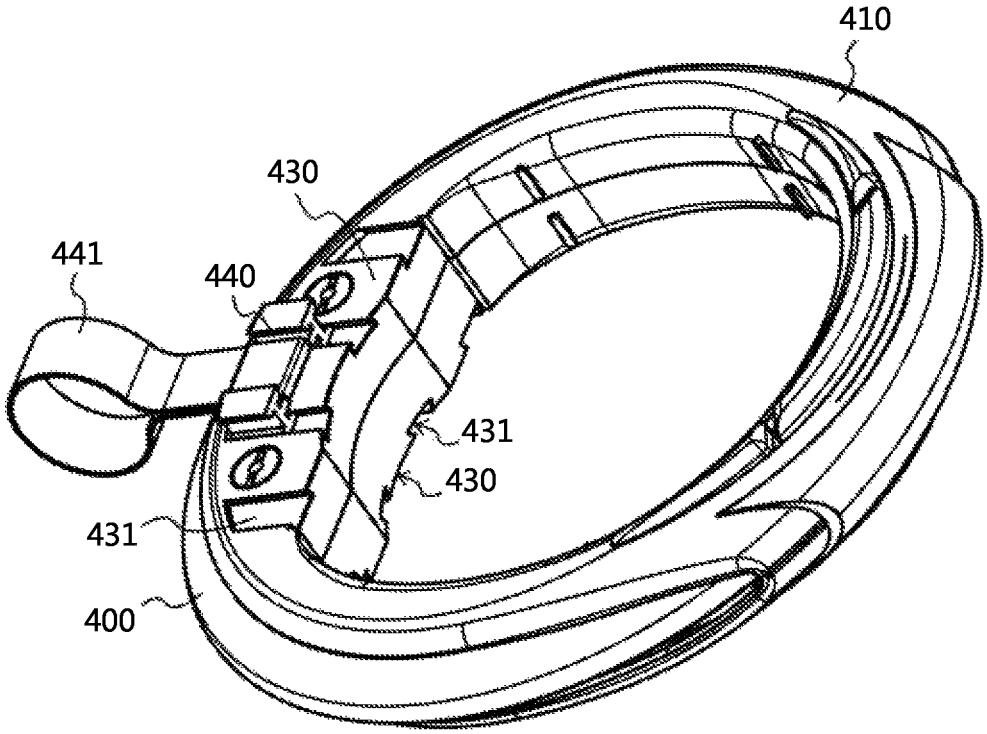
FIG. 4 shows a perspective view of a wheel skate device with one embodiment of a connecting piece and carrying strap attached, where the foot platform is not shown.

Referring to FIG. 4, a perspective view of a wheel skate device in accordance with the present invention is shown without the foot platform. The wheel skate device has a ring-shaped wheel 400 supported by and encircling a frame 410. A separate connecting piece 440 is also shown. When the foot platform has been uncoupled from frame 410 the extruding portions 430 in frame 410 are exposed. Connecting piece 440 is formed in a shape which matches the extruding portions 430 and negative spaces 431 in frame 410, whereby connecting piece 440 can interlock with frame 410 in a way similar to that of the foot platform. The shape of connecting piece 440 is symmetrical in order to couple to the frame of a second wheel skate device on the opposite side, so that connecting piece 440 is sandwiched between the two wheel skate devices. The two wheel skate devices are thereby linked together by means of connecting piece 440, increasing the convenience of carrying or stowage of the two wheel skate devices as a single unit when they are not in use.

Connecting piece 440 may be attached to a strap 441 by which two coupled wheel skate devices may be carried. In addition to carrying by hand, strap 441 also provides a convenient means for the two coupled wheel skate devices to be hung from various other places including (but not limited to) a wall hook or a backpack.

Figure 5:
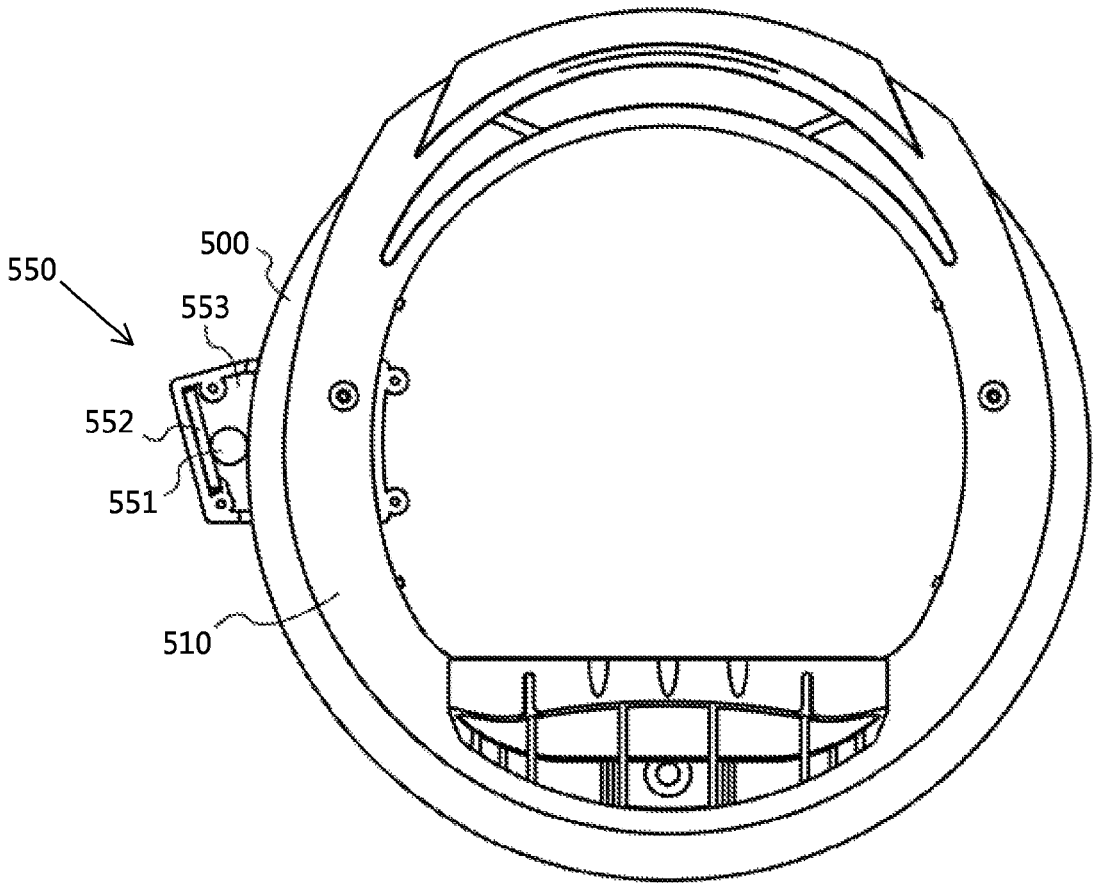
FIG. 5 shows a front elevational view of a wheel skate device with one embodiment of a direction restricting attachment shown in cross section.

Referring to FIG. 5, a side elevational view of a wheel skate device in accordance with the present invention is shown. The wheel skate device has a ring-shaped wheel 500 supported by and encircling a frame 510. A direction-restricting device 550 is shown in cross-section. Direction-restricting device 550 is coupled to wheel 500 and frame 510, for modifying the function of the wheel skate device so that wheel 500 can roll in one direction and not the other. (In FIG. 5 the wheel can roll clockwise but not counterclockwise.) It comprises a rolling piece 551 and a contact surface 552, which are arranged so that rolling piece 551 is in contact with both wheel 500 and contact surface 552, on substantially opposite sides. Friction between wheel 500 and rolling piece 551 causes rolling piece 551 to spin whenever wheel 500 is spinning, but in the opposite direction. In the orientation shown in FIG. 5, when wheel 500 spins clockwise, rolling piece 551 spins counterclockwise. At the same time, friction between contact surface 552 and rolling piece 551 causes rolling piece 551 to advance upward relative to contact surface 552 as it spins. There is an area 553 within which rolling piece 551 is free to move. The orientation of contact surface 552 is such that the width of the upper portion of area 553 is wider than the diameter of rolling piece 551, while the width of the lower portion of area 553 is narrower than the diameter of rolling piece 551. Thus, as wheel 500 spins clockwise and rolling piece 551 rolls upward, rolling piece 551 rests very lightly against wheel 500 and contact surface 552, and its friction with wheel 500 is not sufficient to substantially impede the normal spinning of wheel 500. On the other hand, when wheel 500 begins to spin counterclockwise, rolling piece 551 correspondingly rolls downward into the narrow lower portion of area 553, until it becomes firmly trapped between contact surface 552 and wheel 500. In this position rolling piece 551 cannot spin; and since it is now pressed firmly against wheel 500, wheel 500 is prevented from moving as well. Thus direction restricting device 550 allows wheel 500 to travel substantially in only one direction. This can be useful as an aid for beginners who have not yet mastered the propulsion method of the wheel skate device.

Figure 6:
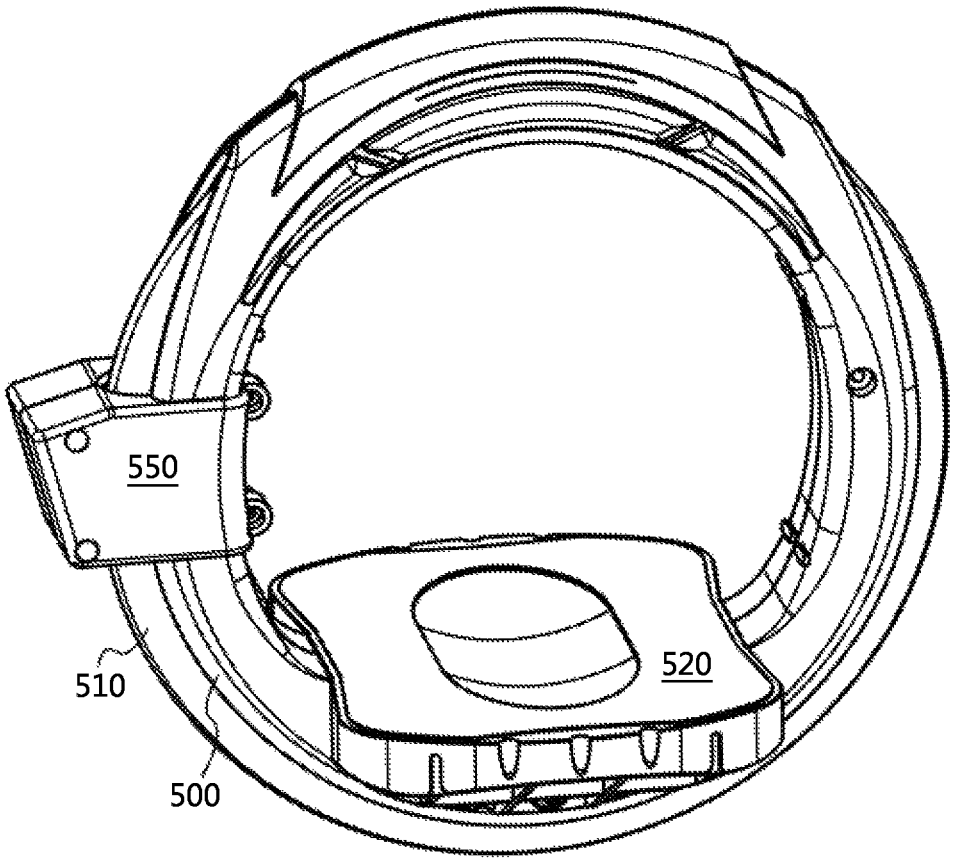
FIG. 6 shows a perspective view of the wheel skate device and direction restricting attachment of FIG. 5, with the complete housing of the direction restricting attachment.

In FIG. 6 the wheel skate device and attached direction restricting device 550 of FIG. 5 are shown, with the housing of direction restricting device 550 shown whole. Different embodiments of the direction restricting device of the present invention may implement the direction restricting function differently from the embodiment described above; the possible variations include embodiments of the wheel skate device wherein a direction restricting mechanism is built into the frame. In this embodiment, however, direction restricting device 550 is a separate attachment which clamps onto wheel 500 and frame 510. The direction restricting device can be attached to aid a beginner in learning to use the wheel skate device, and then removed once the user no longer needs it.

Figure 7:
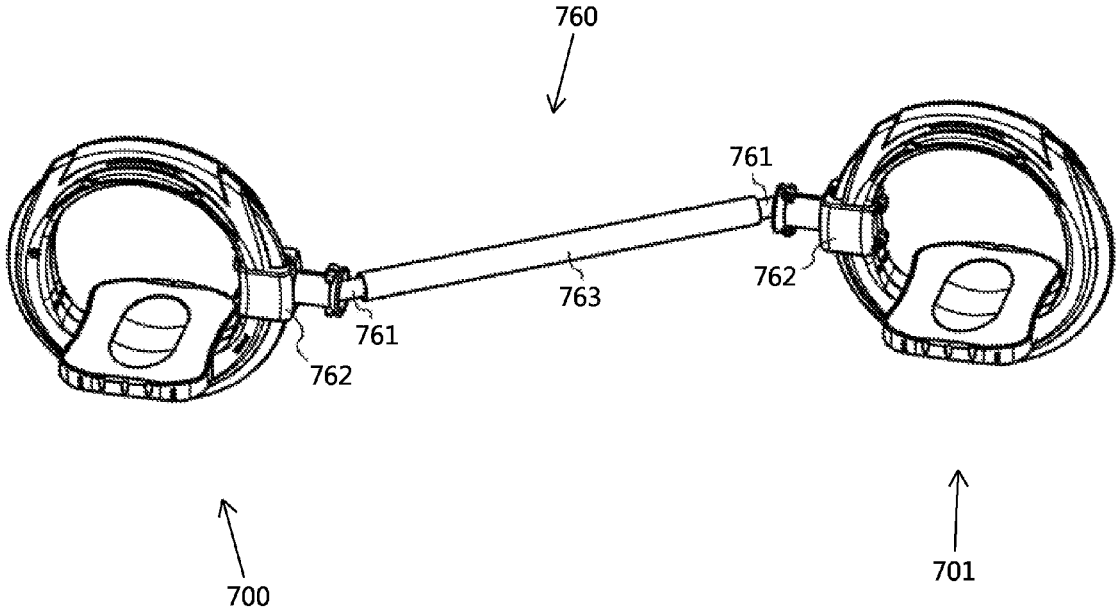
FIG. 7 shows a perspective of a pair of wheel skate devices connected to each other by a linking attachment.

FIG. 7 shows a pair of wheel skate devices 700 and 701, connected together by a linking attachment 760 whose main body is a band 761. The material for band 761 is a strong elastic capable of preventing the feet of a human user—one foot being respectively supported by each wheel skate device 700 and 701—from moving farther apart than a certain distance, the distance being preselected depending on the length and elasticity of band 761 and on the weight of the user). Since usage of linking attachment 760 as a learning aid requires that the user eventually learn to regulate the distance between his feet by himself, the elastic band 761 allows the user to practice a less strenuous version of that skill while assisted by linking attachment 760. To prevent the opposite problem of the user's feet coming too close together (which could cause the user to lose his balance), a rigid separating rod 763 is coupled to band 761. In this embodiment separating rod 763 is a hollow tube fitted around the outside of band 761. Various means for coupling the linking attachment to the wheel skate devices are possible; in this embodiment linking attachment 760 comprises an attaching clamp 762 for respectively coupling each end of elastic band 761 to wheel skate devices 700 and 701.

Figure 8:
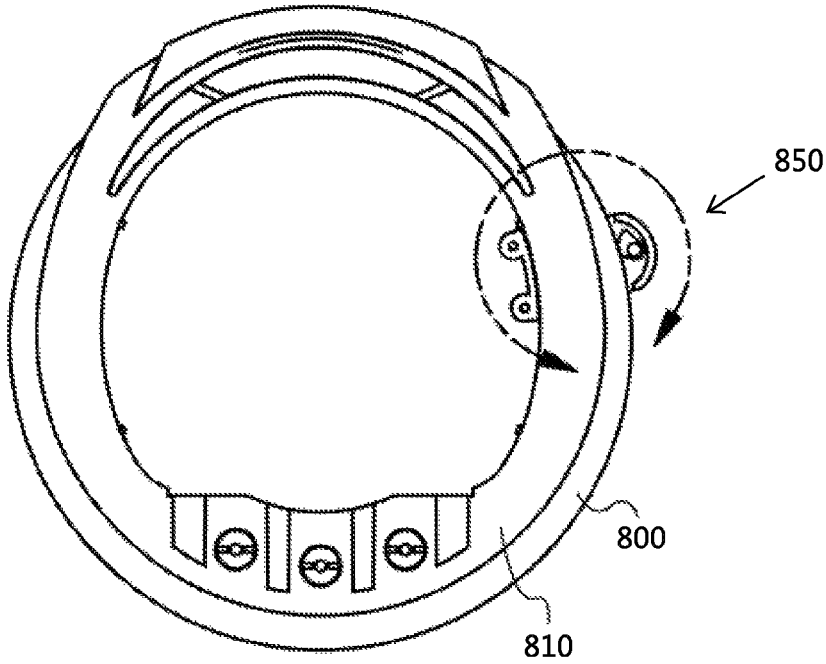
FIG. 8 shows a front elevational view of a wheel skate device with another embodiment of a direction restricting attachment shown in cross section.
Figure 8:
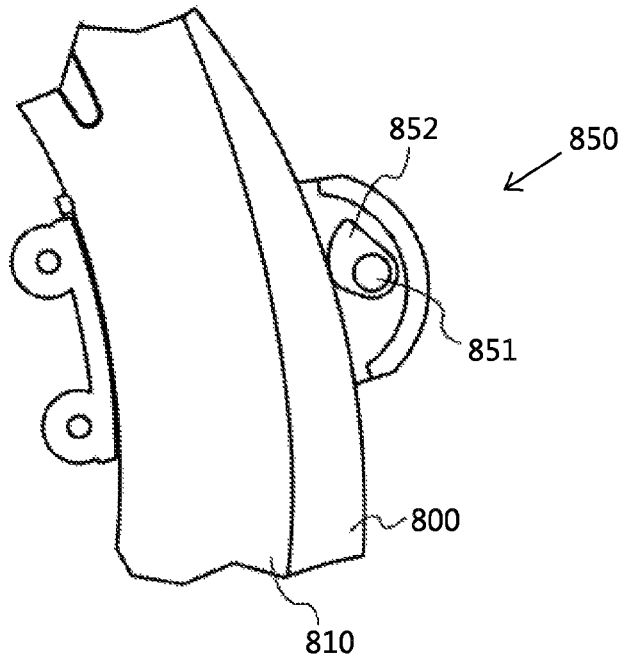

Referring to FIG. 8, a side elevational view of a wheel skate device in accordance with the present invention is shown. The wheel skate device has a ring-shaped wheel 800 supported by and encircling a frame 810. Another embodiment of a direction-restricting device 850 (different from the one in FIG. 5) is shown in cross-section. Direction-restricting device 850 is coupled to wheel 800 and frame 810, for modifying the function of the wheel skate device so that wheel 800 can roll in one direction and not the other. (In FIG. 5 the wheel can roll counterclockwise but not clockwise.) It comprises a blocking piece 852 rotatable about a shaft 851. These are arranged so that blocking piece 852 is in contact with wheel 800, and friction between wheel 800 and blocking piece 852 causes blocking piece 852 to rotate in the opposite direction from wheel 800 whenever the wheel is spinning. The surface of 852 which contacts wheel 800 is curved, with an upper portion of the curve being farther away from the center of rotation (shaft 851) than the lower portion. In the orientation shown in FIG. 8, when wheel 800 spins counterclockwise, blocking piece 852 pivots clockwise, whereby the area of contact between wheel 800 and blocking piece 852 moves lower on blocking piece 852. On the lower portion of blocking piece 852 the width from shaft 851 to the edge of blocking piece 852 is sufficiently short such that friction between 800 and blocking piece 852 is low and does not significantly resist the spinning of wheel 800. On the other hand, when wheel 800 spins clockwise, blocking piece 852 pivots counterclockwise, the area of contact between wheel 800 and blocking piece 852 moves higher on blocking piece 852. The width of the upper portion of blocking piece 852 is sufficiently long such that friction between 800 and blocking piece 852 becomes strong enough to impede the spinning of wheel 800. A boundary means is provided for limiting the range of rotation of blocking piece 852. By this mechanism wheel 800 is allowed to travel in only one direction. As with direction restricting device 550 of FIG. 5, direction restricting device 850 can be implemented as a separate attachment which can be coupled to wheel 800 and frame 810.

The invention claimed is:

1. A wheel skate device comprising:

a foot placement platform;

a frame that encircles the foot placement platform during use; and a wheel supported by the frame that is rotatable about a wheel axis, the wheel encircling the foot of a user standing on the foot placement platform during use;

wherein the foot placement platform is movable relative to the frame between a first in-use position and a second stowage position, the foot placement platform in the in-use position projecting outwardly from the frame more so than in the stowage position; and wherein the foot placement platform and the frame each have a plurality of extruding portions shaped such that the extruding portions of the foot placement platform can interlock with the extruding portions of the frame, thereby reducing the range of movement of the foot placement platform relative to the frame when interlocked.

2. The wheel skate device of claim 1, further comprising a locking pin encased in the frame, wherein the locking pin is:

capable of sliding between a flush position in which it does not extend substantially beyond the outer surface of the frame, and an extruding position in which it extends at least partially beyond the outer surface of the frame; and biased toward the extruding position; and wherein a hole of size and shape comparable to the portion of the locking pin extended when in extruding position is provided in the foot placement platform, the hole being capable of receiving the locking pin when the foot placement platform is in the in-use position.

3. The wheel skate device of claim 1. further comprising an attachable connecting piece for linking the wheel skate device to another substantially identical wheel skate device when both are in stowage position, wherein the connecting piece has a shape generally corresponding to that of the extruding portions on the frames of the wheel skate devices, whereby the connecting piece can interlock with the respective frames of both wheel skate devices.

4. The wheel skate device of claim 3, further comprising a strap attached to the connecting piece for carrying or hanging a pair of wheel skate devices when they are coupled to the connecting piece.

5. The wheel skate device of claim 1. further comprising a direction restricting mechanism which allows the wheel to spin relative to the frame in only one direction and not the other.

6. The wheel skate device of claim 5, wherein the direction restricting mechanism comprises:

a rolling piece in contact with the wheel and capable of spinning;

a contact surface in contact with the rolling piece, on generally the opposite side of the rolling piece from the wheel; wherein the contact surface and the wheel are separated by a gap within which the rolling piece can move relative to the contact surface, the gap having an upper portion wider than the diameter of the rolling piece and a lower portion narrower than the diameter of the rolling piece; wherein friction between the rolling piece and the wheel causes the rolling piece to spin in the opposite direction from the wheel whenever the wheel is spinning; and wherein friction between the contact surface and the rolling piece causes the rolling piece to be displaced upward relative to the contact surface when the wheel spins in one direction and downward when the wheel spins in the other direction.

7. The wheel skate device of claim 5, wherein the direction restricting mechanism is configured as a removable attachment, and wherein the wheel can spin freely in either direction when the direction restricting mechanism is detached.

8. The wheel skate device of claim 5, wherein the direction restricting mechanism comprises:

a blocking piece rotatable about an axis and having a contact surface which is in contact with the wheel, the contact surface having a non-uniform radius from the axis, wherein an upper part of the contact surface has a longer radius than a lower part;

means for limiting the range of rotation of the contact surface so that the contact surface remains generally in contact with the wheel; wherein friction between the contact surface and the wheel causes the blocking piece to rotate in the opposite direction from the wheel whenever the wheel is spinning.

9. The wheel skate device of claim 1. further comprising a linking attachment for use as a learning aid for a pair of the wheel skate devices, comprising: an elongated elastic element; a rod coupled to the elastic element so as to be substantially parallel with the elastic element; and means for removably coupling each of the two ends of the linking attachment to a respective wheel skate device.

* * * * *